US005224239A

United States Patent [19]

Cuthbert, Jr.

[11] Patent Number: 5,224,239

[45] Date of Patent: Jul. 6, 1993

[54] LITTER TRAP

[75] Inventor: Hugh T. Cuthbert, Jr., 39 Barlow La., Rye, N.Y. 10580

[73] Assignee: Hugh T. Cuthbert, Jr., Rye, N.Y.

[21] Appl. No.: 698,962

[22] Filed: May 13, 1991

Related U.S. Application Data

[63] Continuation of Ser. No. 361,284, Jun. 5, 1989, abandoned.

[51] Int. Cl.[5] ..... A47L 5/14

[52] U.S. Cl. ..... 15/347; 15/257.4; 15/405; 220/493; 294/55

[58] Field of Search ..... 15/1.7, 257.1, 405, 15/257.4, 347; 220/1 R; 294/55

[56] References Cited

U.S. PATENT DOCUMENTS

| | | | |
|---|---|---|---|
| 2,545,226 | 3/1951 | Claude | 294/55 |
| 3,063,077 | 11/1962 | Pansini | 15/1.7 |
| 3,287,755 | 11/1966 | Pansini | 15/1.7 |
| 3,627,368 | 12/1971 | Baughman | 15/257.1 X |
| 3,722,023 | 3/1973 | Gray | 294/55 X |
| 3,863,237 | 1/1975 | Doerr | 294/55 X |
| 3,942,831 | 3/1976 | Sosnove | 15/257.4 X |
| 3,979,146 | 9/1976 | Berg | 15/257.1 X |
| 4,325,163 | 4/1982 | Mattson et al. | 15/405 X |
| 5,107,564 | 4/1992 | Grumbles | 15/257.1 |

FOREIGN PATENT DOCUMENTS

| | | | |
|---|---|---|---|
| 103632 | 4/1938 | Australia | 15/257.4 |
| 1039125 | 5/1953 | France | 15/257.4 |
| 15505 | of 1909 | United Kingdom | 15/257.4 |

*Primary Examiner*—Chris K. Moore

[57] ABSTRACT

Apparatus for cleaning litter such as paper from a surface and a method of using such apparatus are described. An open-end portable basket is provided made of wire mesh to hold the litter while allowing dirt and air to pass therethrough. A portable hand held blower directs the litter from the surface into the basket. The basket retains the litter but allows air and surface dirt to pass therethrough.

4 Claims, 2 Drawing Sheets

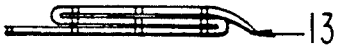
FIG. 6
FIG. 7
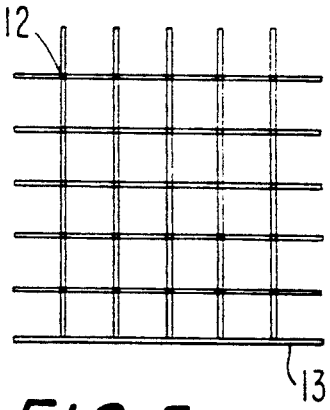
FIG. 5
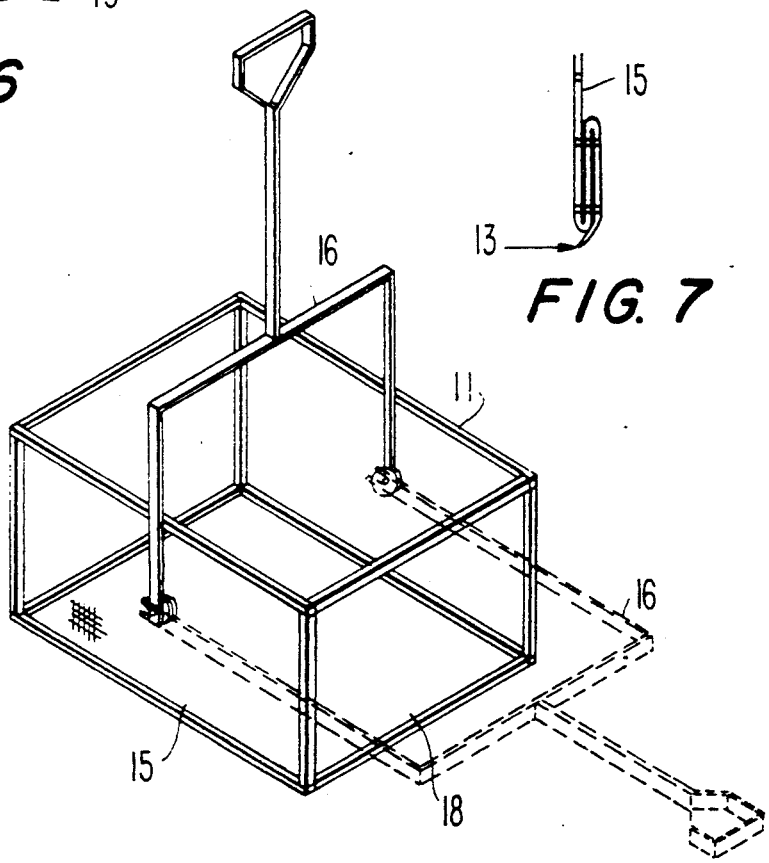
FIG. 4

LITTER TRAP

This application is a continuation of application Ser. No. 07/361284 filed Jun. 5, 1989 entitled Litter Trap Basket now abandoned.

OBJECT OF THE INVENTION

An object of this invention is to provide apparatus comprising a portable container which will entrap litter as cigarette butts and paper while enabling air and dirt to pass therethrough when such litter from a walk, for example, is blown into the container by means of a portable or hand-held blower.

Additional reasons for my invention being made entirely of mesh are:

lighter weight for ease in portability;

top and bottom are interchangeable, doubling the durability from wear and tear;

when the basket is lifted from the surface, any dirt blown therein will pass through the mesh and thus remain on the surface.

DESCRIPTION OF THE PRIOR ART

The procedure for removing outdoor sidewalk and street litter has been:

To stoop over and pick it up by hand; whereupon it is dropped into a container.

To sweep dust, dirt, rubbish and refuse with a broom into a dustpan made of sheet metal with a stand-up handle. It is inverted to empty into a large container.

The use of a pole, having a protruding spike at one end, to stab into paper and plastic litter lodged on grass or earth whereupon the litter is then removed by wiping it off into a bag or other container.

Scooping, shoveling or sweeping litter into a solid bottom with scooping edge or shovel with a metallic screen hood attached thereto for collecting the litter, heavy soil and sand, as disclosed in patent to Baughman 3627368.

The use of a gasoline-powered vacuum cleaner wheeled over the litter which is sucked into a bag or container.

A pincer device on the working end of a pole with a trigger handle that is squeeze, opening and closing the pincer to grab the litter, lift it to a bag, squeeze the trigger grip again to release the litter into a container.

The use of a water hose and nozzle. The force of water pressure washes the litter into the street, where it flows into the catch basin, whereupon it is periodically cleaned out or let flow into the storm sewer.

The customary city street cleaner uses revolving brushes and vacuum to push or suck litter into its container.

A wide shovel and push-broom to sweep litter thereon, whereby it is lifted and emptied into a container on wheels.

DESCRIPTION OF THE DRAWINGS

FIG. 4 is a perspective right view of the litter-trap basket;

FIG. 5 is 4×4 mesh with hemmed edge 8;

FIG. 6 is an inside two-fold for the interchangeable top and bottom open-end front edges;

FIG. 7 is an outside two-fold for the two sides open-end front edges.

DETAILED DESCRIPTION OF THE INVENTION

The invention comprises the combination of a portable blower and a specially constructed basket for removal of litter from a surface as hereinabove described.

A portable blower, electrically powered, preferably by a rechargeable battery, is hand-held by an operator to blow or move litter into the open end of the described basket while paper, cigarette butts and like litter on a surface such as a sidewalk are thus entrapped in the basket.

Dirt, dust, etc., pass through the open mesh leaving only the litter to be carried away. Some such dirt blown into the basket which lies on the sidewalk for instance, will fall through the mesh when the basket is lifted, thus remaining on the sidewalk while the litter is carried away.

Portable or hand-held blowers as such are readily available on the market. One portable blower which is powered by a rechargeable battery is available for instance from Black & Decker, Model #82460, Sweep-stick Cordless Broom.

Figure 1:
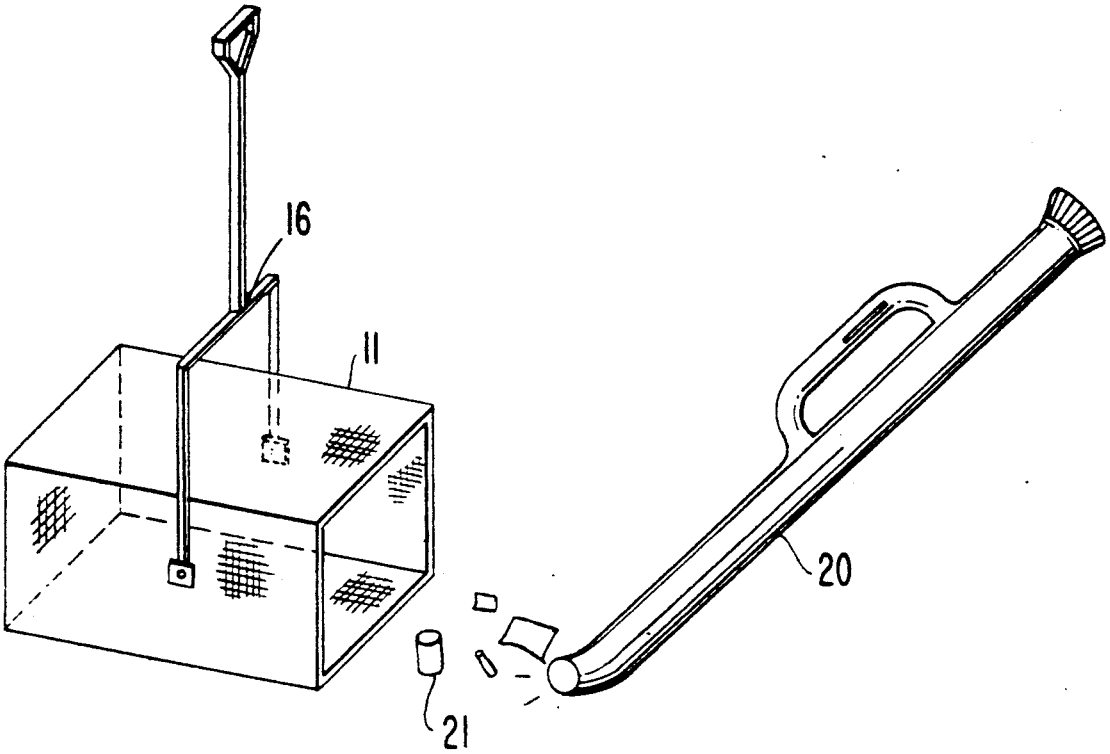
FIG. 1 is a blower propelling litter into the open-end litter-trap basket.
Figure 2:
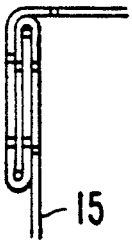
FIG. 2 is a cross section view of a four thickness fold joining, as viewed, the top and interchangeable bottom section 7 to the left side section 6; all five sections are joined by the tinner's lap method.

The open-end rectangular receptacle 11 FIGS. 1, 4 is made with five sections of a manufacturer's fabricated 4×4 0.025 inch wire screen mesh 12 FIG. 5 plain woven malleable galvanized steel cloth with a hemmed edge 13 FIGS. 5, 6, 7, welded to the shute wire ends. The open-end hemmed edges FIGS. 6, 7 of the top, bottom and two side sections are double folded making a three-cloth thickness for added rigidity. The top and bottom sections are identical and interchangeable in use, with the inside open-end hemmed edge 13 FIG. 6 consisting of two square openings back fold and three square openings forward fold with one square opening bent down FIG. 6 to form a flat entrance scoop. The open-end hemmed edge FIG. 7 on each identical side section 15 have, on the outside, a one square opening back fold and two square opening forward fold with one square opening at the edge bent inward. A fold is made along the middle of a row of square openings FIGS. 2, 6, 7. The five sections, interchangeable top and bottom, two sides and the back are assembled by a single fold of one square opening at the edge FIG. 2 of each section meshed together creating a tight tinner's lap of four cloth thicknesses, giving the receptacle sufficient rigidity and strength. FIG. 2 shows the side outside fold tinner's lap seams to the top and bottom, then bent at a right angle, FIG. 2 is the back tinner's lap seam to the outside fold two sides, top and bottom seams. The cut wire edges are enclosed within the folds FIG. 2.

Figure 3:
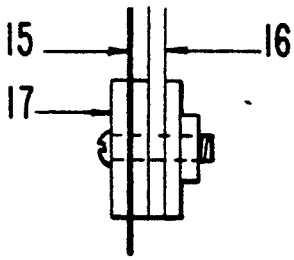
FIG. 3 is a right side cross section view of the strap-sling handle attachment. Machine screw 1, 3 fender washers 2, mesh 3, handle 4, hex locknut 5.

A one-piece strap-sling handle 16 FIG. 1, and 4 is attached on the outside center of both side sections 15 with a round head machine screw 1 FIG. 3 through three fender washers 17 FIG. 3; one washer on the inside and outside of the side sections 15 FIG. 3 and the third washer outside the strap-sling handle 16 FIG. 3 secured with a hex locknut FIG. 3. The handle extension FIG. 1 and 4 is joined by two spot welds below the handle 45 degree flair. The strap-sling handle 16 FIG. 4 preferably rotates 360 degrees around the receptacle 11 to render the top and bottom interchangeable. The handle 16 may be rotated toward the open-end to carry upright when filled or rotated to the back to invert and empty the basket.

Wind from the hand held blower 20 propels litter 21 from the surface into the litter-trap 11 as illustrated in FIG. 8.

I claim:

1. A litter-trap comprising: an open-end rectangular receptacle having five wall sections, being made of metal screen mesh consisting of a top, bottom, two sides and a back, said screen mesh being of size sufficient to permit passage of air and dirt while trapping litter a rotatable handle attached to the sides thereof, and a portable blower for forcing litter by air into said receptacle.

2. Apparatus for removing litter from a surface comprising the combination of a portable air blower and a portable basket, said blower being hand held and having internal power means for blowing litter by air into said basket, said basket comprising an open end rectangular receptacle having five wall sections, being made of metal screen mesh consisting of a top, bottom, two sides and a back, said screen mesh being of size sufficient to permit passage of air while trapping litter, and a strap-sling handle attached to the outside approximate center of the said two side sections to enable said handle to rotate across the top of said basket.

3. The apparatus of claim 2 in which the said handle is enabled to rotate across the said open end of said basket.

4. The apparatus of claim 2 in which the said handle is enabled to rotate 180 degrees across the top, open end and bottom of said basket.

* * * * *